US009926950B2

(12) United States Patent
Ooki et al.

(10) Patent No.: US 9,926,950 B2
(45) Date of Patent: Mar. 27, 2018

(54) HYDRAULIC SYSTEM FOR CONSTRUCTION MACHINERY

(71) Applicant: HITACHI CONSTRUCTION MACHINERY CO., LTD., Tokyo (JP)

(72) Inventors: Takatoshi Ooki, Kasumigaura (JP); Seiji Hijikata, Tsukuba (JP); Kouji Ishikawa, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 332 days.

(21) Appl. No.: 14/753,374

(22) Filed: Jun. 29, 2015

(65) Prior Publication Data

US 2015/0377264 A1 Dec. 31, 2015

(30) Foreign Application Priority Data

Jun. 30, 2014 (JP) ..... 2014-135131

(51) Int. Cl.
*F16D 31/02* (2006.01)
*F15B 20/00* (2006.01)
(Continued)

(52) U.S. Cl.
CPC ..... *F15B 20/007* (2013.01); *E02F 9/2095* (2013.01); *E02F 9/2217* (2013.01); *E02F 9/2285* (2013.01); *E02F 9/2296* (2013.01); *E02F 9/268* (2013.01); *F15B 11/024* (2013.01); *F15B 15/14* (2013.01); *F15B 20/002* (2013.01); *F15B 21/14* (2013.01); *F15B 2211/20546* (2013.01); *F15B 2211/3058* (2013.01); *F15B 2211/31* (2013.01); *F15B 2211/40515* (2013.01); *F15B 2211/415* (2013.01); *F15B 2211/41527* (2013.01); *F15B 2211/6355* (2013.01); *F15B 2211/7053* (2013.01); *F15B 2211/8623* (2013.01); *F15B 2211/8626* (2013.01); *F15B 2211/88* (2013.01)

(58) Field of Classification Search
CPC ..... F15B 11/024; F15B 2011/0243; F15B 20/002; F15B 20/007; F15B 20/008; F15B 21/14; F15B 2211/865
USPC ..... 60/403, 414; 91/450, 461
See application file for complete search history.

(56) References Cited

U.S. PATENT DOCUMENTS

2015/0152900 A1* 6/2015 Egawa ..... E02F 9/2285 60/419
2016/0237648 A1* 8/2016 Kawasaki ..... F15B 21/14

FOREIGN PATENT DOCUMENTS

JP 2007-327527 A 12/2007
WO WO 2014017492 A1 * 1/2014 ..... F15B 21/14

* cited by examiner

*Primary Examiner* — Michael Leslie
(74) *Attorney, Agent, or Firm* — Mattingly & Malur, PC

(57) ABSTRACT

A hydraulic system for construction machinery is capable of suppressing irregularity in the operation of the front structure not intended by the operator, and includes a regeneration motor adapted to be driven by return fluid from a bottom port of a boom cylinder; a regeneration electric motor converting rotary power into electric energy; return fluid control valves controlling the flow of the return fluid according to a pilot pressure related to an operation of a boom control lever; and a malfunction prevention device adapted to be activated by pressure fluctuation caused by malfunction of a solenoid valve for the return fluid control valve that interrupts the delivery of a pilot secondary pressure from the solenoid valve to the corresponding return fluid control valve.

4 Claims, 5 Drawing Sheets

(51) Int. Cl.

| | |
|---|---|
| ***F15B 11/024*** | (2006.01) |
| ***F15B 15/14*** | (2006.01) |
| ***E02F 9/20*** | (2006.01) |
| ***E02F 9/22*** | (2006.01) |
| ***E02F 9/26*** | (2006.01) |
| ***F15B 21/14*** | (2006.01) |

HYDRAULIC SYSTEM FOR CONSTRUCTION MACHINERY

BACKGROUND OF THE INVENTION

1. Field of the Invention

The present invention relates to a hydraulic system for a construction machinery such as a hydraulic excavator.

2. Description of the Related Art

In a construction machinery such as a hydraulic excavator, hydraulic actuators are driven by hydraulic pressure (pressure of hydraulic fluid) obtained by driving a hydraulic pump by using a prime mover (engine, electric motor, etc.). The hydraulic actuators are small-sized, lightweight and high-power actuators and are widely used as actuators for construction machineries. In a hydraulic excavator that drives its front structure by using a hydraulic cylinder, the front structure can be moved in the gravitational direction by using the front structure's potential energy as the power for the movement, without the need of inputting hydraulic energy.

In this case, the speed of the front structure in the gravitational direction has to be controlled properly. For the control of the descending speed of the front structure, conventional construction machineries generally throttle the meter-out opening area of the control valve while dumping the hydraulic energy of the hydraulic fluid in the form of heat. In contrast, there exists a construction machinery comprising a regeneration device including a hydraulic motor and an electric motor and recovering the hydraulic energy (generally dumped in the form of heat) as electric energy by driving the electric motor with the hydraulic motor driven by the return fluid returning to the tank (see JP, A 2007-327527 (hereinafter referred to as "Patent Document 1"), for example).

SUMMARY OF THE INVENTION

There are cases where such a construction machinery comprising the regeneration device has a return fluid control valve for controlling the flow of the return fluid from a hydraulic actuator in relation to the flow rate control of the return fluid flowing into the regeneration device. The construction machinery described in Patent Document 1 employs a return fluid control valve of the solenoid pilot type. Compared to a return fluid control valve of a hydraulic type that is assumed to be controlled purely hydraulically, the return fluid control valve of the solenoid pilot type is capable of performing more meticulous control according to the current condition by taking advantage of the merit of the electrical control. For example, when the front structure is moved in the gravitational direction, the return fluid control valve of the solenoid pilot type is capable of making the front structure smoothly start the descent by blocking the flow of the return fluid into the regeneration device and returning all the return fluid to the tank at the beginning of the descent.

However, in cases like a malfunction of a solenoid valve in contradiction to the control logic due to trouble in the electric system (a power supply failure of a solenoid valve driver, a failure of a controller, etc.), an abnormality can occur to the control of the return fluid and an irregularity not intended by the operator can occur to the operation of the front structure.

The object of the present invention, which has been made in consideration of the above-described situation, is to provide a hydraulic system for a construction machinery capable of suppressing the irregularity in the operation of the front structure not intended by the operator.

To achieve the above object, a hydraulic system for a construction machinery according to a an aspect of the present invention comprises: a hydraulic pump; a cylinder control valve adapted to control the flow of hydraulic fluid from the hydraulic pump to a hydraulic cylinder; an operating device adapted to operate the cylinder control valve; a regeneration motor adapted to be driven by return fluid from one hydraulic fluid port of the hydraulic cylinder; a regeneration electric motor adapted to convert rotary power of the regeneration motor into electric energy; a pilot hydraulic pressure source; at least one return fluid control valve adapted to control the flow of the return fluid according to pilot pressure that is led from the pilot hydraulic pressure source in conjunction with an operation on the operating device; at least one solenoid valve for return fluid control valve adapted to control the pilot pressure for driving the return fluid control valve; and a malfunction prevention device adapted to be capable of interrupting the delivery of the pilot pressure from the solenoid valve for return fluid control valve to the return fluid control valve.

DESCRIPTION OF THE PREFERRED EMBODIMENTS

Figure 1:
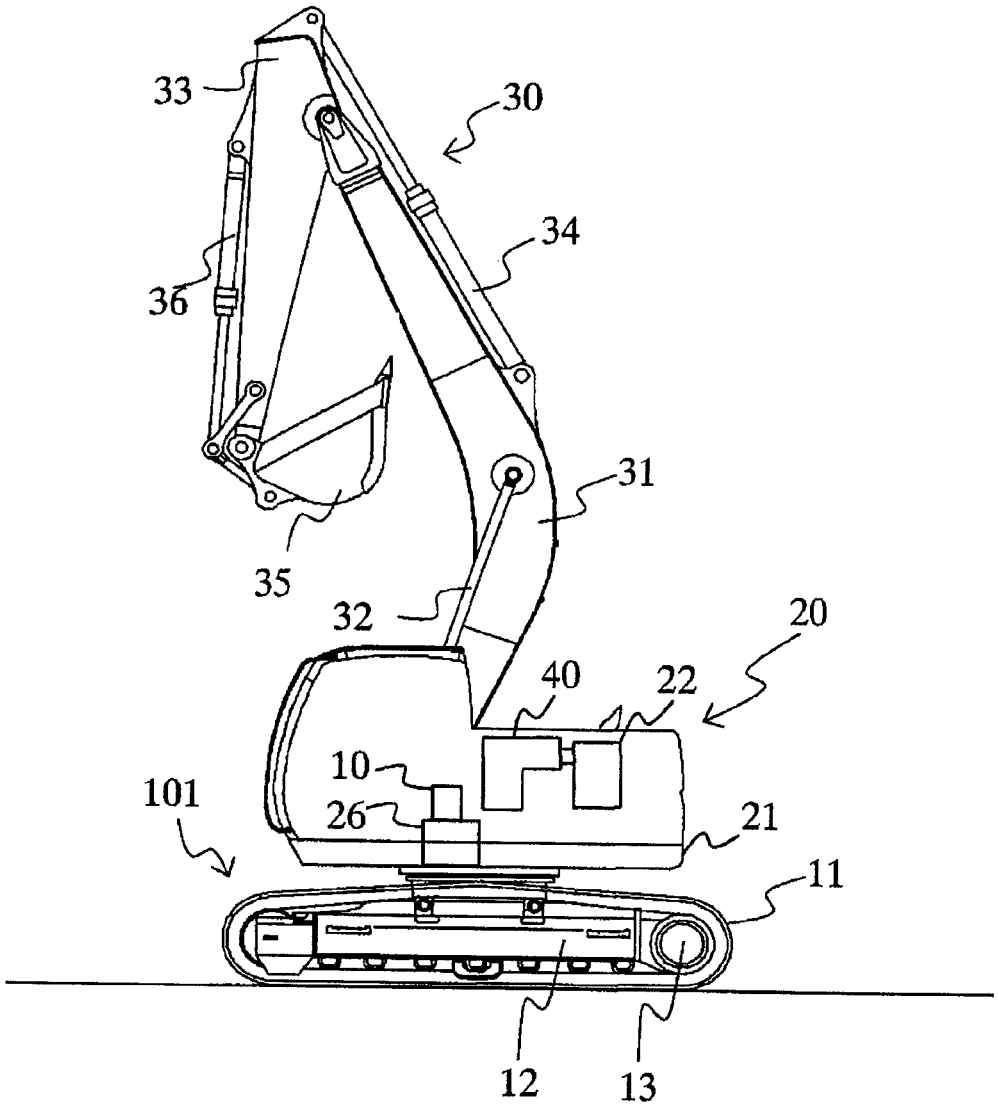
FIG. 1 is a schematic diagram showing a hydraulic excavator as an example of the target of application of a hydraulic system according to the present invention.

Referring now to the drawings, a description will be given in detail of preferred embodiments of the present invention.

First Embodiment

1. Construction Machinery

FIG. 1 is a schematic diagram showing a hydraulic excavator as an example of the target of application of the hydraulic system according to the present invention.

The hydraulic excavator shown in FIG. 1 comprises a track structure 101, a swing structure (main body) 20, an excavation mechanism (front structure) 30, and a hydraulic system 40.

The track structure 101 includes a pair of (left and right) crawlers 11 (only one side is shown in FIG. 1), a crawler frame 12 as the frame for the crawlers 11, left and right travel hydraulic motors 13 provided respectively for the left and right crawlers 11, deceleration mechanisms provided respectively for the left and right travel hydraulic motors 13, and so forth.

The swing structure 20 includes a swing frame 21, an engine (prime mover) 22 mounted on the swing frame 21, a swing hydraulic motor 10 for swinging (rotating) the swing structure 20 with respect to the track structure 101, a deceleration mechanism 26 for reducing the revolution speed of the swing hydraulic motor 10, a cab in which the operator rides, and so forth.

The excavation mechanism 30 is provided in a front part (where the cab is arranged) of the swing structure 20. The excavation mechanism 30 includes a boom 31 which can be raised and lowered, a boom cylinder 32 for driving the boom 31, an arm 33 which is supported by the boom 31 to be rotatable around an axis in the vicinity of the tip end of the boom 31, an arm cylinder 34 for driving the arm 33, a bucket 35 which is supported by the arm 33 to be rotatable around an axis in the vicinity of the tip end of the arm 33, a bucket cylinder 36 for driving the bucket 35, and so forth.

2. Hydraulic System

The hydraulic system 40 is a device (system) for driving and controlling hydraulic actuators such as the swing hydraulic motor 10, the travel hydraulic motors 13, the boom cylinder 32, the arm cylinder 34 and the bucket cylinder 36. The hydraulic system 40 is mounted on the swing structure 20. The hydraulic system 40 has an energy regeneration circuit which recovers energy by converting the hydraulic energy of the return fluid from a hydraulic actuator (assumed to be the boom cylinder 32 in this embodiment) into electric energy.

Figure 2:
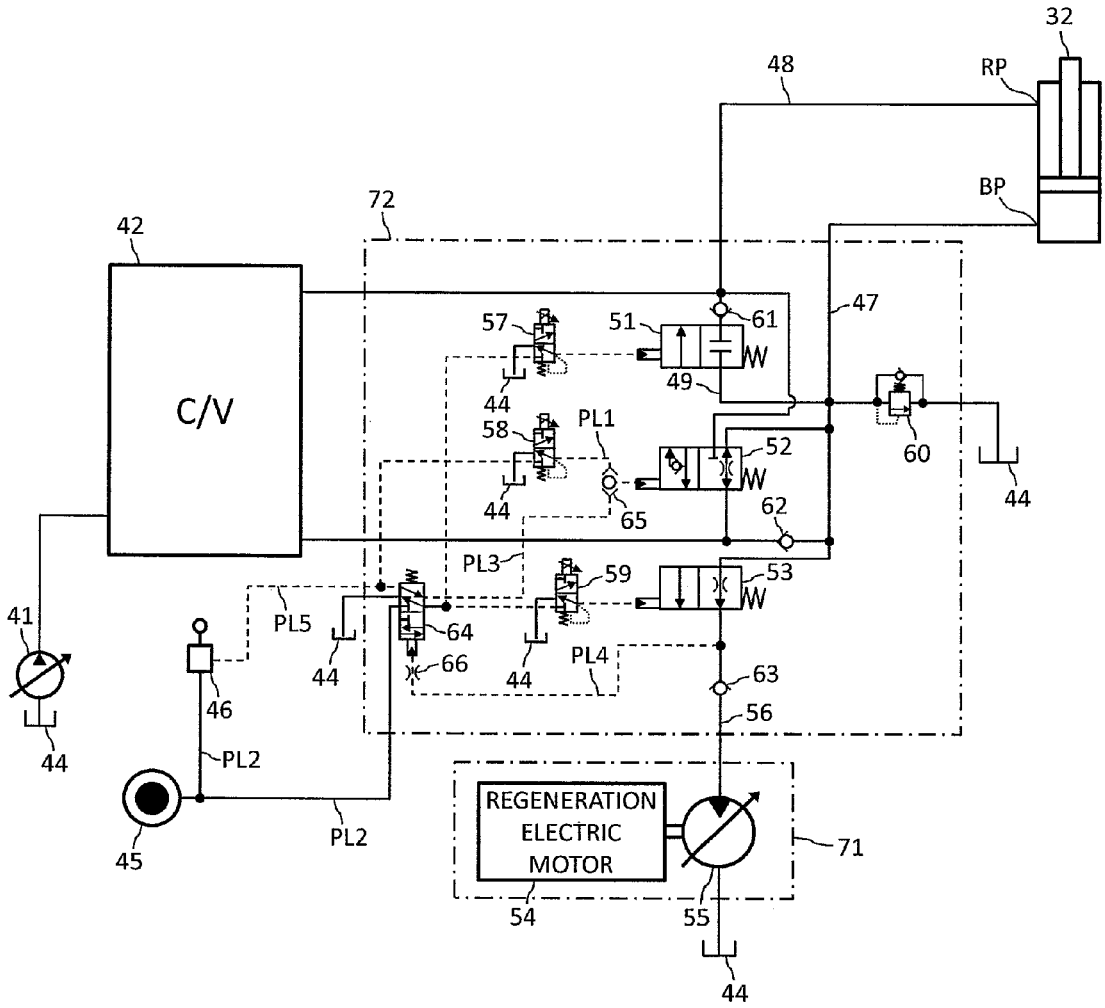
FIG. 2 is a hydraulic circuit diagram of a hydraulic system in accordance with a first embodiment of the present invention including an energy regeneration circuit.

FIG. 2 is a hydraulic circuit diagram of a hydraulic system in accordance with a first embodiment of the present invention including the energy regeneration circuit.

As shown in FIG. 2, the aforementioned boom cylinder 32 is a hydraulic cylinder of the single rod type having a port (as the inlet and outlet for the hydraulic fluid) both on the bottom-side chamber and on the rod-side chamber. In this specification, the port on the bottom-side chamber will be referred to as a bottom port BP and the port on the rod-side chamber will be referred to as a rod port RP. A bottom line 47 is connected to the bottom port BP, while a rod line 48 is connected to the rod port RP. The boom cylinder 32 is driven by the hydraulic fluid delivered from a hydraulic pump 41. The bottom line 47 has a relief valve 60 which prescribes the maximum pressure in the bottom line 47 and thereby protects the bottom line 47.

The hydraulic system 40 shown in FIG. 2 comprises the hydraulic pump 41, a pilot hydraulic pressure source 45, a control valve 42, a boom control lever 46 (as an operating device for driving the control valve 42), a regeneration device 71, and a regeneration valve unit 72. The regeneration valve unit 72 includes a return fluid control valve, a solenoid valve for return fluid control valve, and a malfunction prevention device, which are explained later.

(1) Pump

The hydraulic pump 41 sucks in the hydraulic fluid from a tank 44 and delivers (discharges) the hydraulic fluid as pressurized fluid for driving the hydraulic actuators. The pilot hydraulic pressure source 45 is a constant pressure source which constantly generates a constant pilot primary pressure. The hydraulic pump 41 and the pilot hydraulic pressure source 45 are driven by the engine 22 in this embodiment.

(2) Control Valve

The control valve 42 has the function of controlling the flow (flow rate and direction) of the hydraulic fluid supplied from the hydraulic pump 41 to the boom cylinder 32. The control valve 42 is connected to the delivery line of the hydraulic pump 41. While details are not illustrated in FIG. 2, the control valve 42 has functions of switching the connection of the delivery line of the hydraulic pump 41 between the bottom line 47 and the rod line 48, restricting the flow of the hydraulic fluid supplied to the bottom line 47 or the rod line 48, interrupting the connection between the delivery line of the hydraulic pump 41 and the bottom line 47 or the connection between the delivery line and the rod line 48, and so forth.

(3) Boom Control Lever

The boom control lever 46 has a pressure reducing valve function of reducing the pressure supplied from the pilot hydraulic pressure source 45 according to the lever operation amount. The boom control lever 46 operates the control valve 42 by supplying a pressure according to the lever operation amount to the control valve 42.

(4) Regeneration Device

The regeneration device 71 includes a regeneration motor 55 and a regeneration electric motor 54. The regeneration motor 55 is connected to a regeneration line 56 branching from the bottom line 47. The regeneration motor 55 is adapted to be driven by the hydraulic fluid returning from the bottom port BP of the boom cylinder 32 and lead to the regeneration line 56. The regeneration electric motor 54 is mechanically connected to the regeneration motor 55 and adapted to convert the rotary power of the regeneration motor 55 into electric energy. The electric energy generated by the regeneration electric motor 54 is supplied to the electric system of the hydraulic excavator or stored in a battery (not shown), for example. The hydraulic fluid after driving the regeneration motor 55 returns to the tank 44. Incidentally, the regeneration device 71 has an inverter (not shown) for controlling the revolution speed of the regeneration motor 55. The inverter has been set so that the revolution speed of the regeneration motor 55 becomes 0 when a regeneration valve 53 (explained later) is at a throttling position, for example.

(5) Return Fluid Control Valve

The return fluid control valve in this specification means a valve having a certain function for controlling the flow of the return fluid according to pilot pressure that is led from the pilot hydraulic pressure source 45. The hydraulic system is provided with at least one return fluid control valve. In this embodiment, a bypass valve 51, a flow control valve 52 and the regeneration valve 53 are provided as the return fluid control valves.

Bypass Valve

The bypass valve 51, as a selector valve having a closed position and an open position, is arranged in a bypass line 49 connecting the bottom line 47 and the rod line 48. The bypass valve 51 is biased by a spring toward the closed position (the state shown in FIG. 2) and is switched continuously from the closed position to the open position according to the pilot pressure inputted to its pilot pressure port. In the boom lowering operation, surplus hydraulic fluid (beyond the rated flow rate of the regeneration device 71, for example) is discharged to the tank 44 and the hydraulic energy of the hydraulic fluid flowing into the tank 44 is dumped in the form of heat. In this case, the energy recovery efficiency is increased by opening the bypass valve 51 and returning part of the return fluid from the bottom line 47 to the rod line 48. The bypass valve 51 also functions as the aforementioned return fluid control valve in the sense of distributing part of the return fluid in the bottom line 47 into the rod line 48. A check valve 61 is arranged in the bypass line 49 at a position between the bypass valve 51 and the rod line 48. By the check valve 61, the flow of the hydraulic fluid from the bottom line 47 to the rod line 48 via the bypass line 49 is allowed while blocking the flow of the hydraulic fluid from the rod line 48 to the bottom line 47.

Flow Control Valve

The flow control valve 52, as a selector valve having a throttling position and an open position, is arranged in the bottom line 47. The flow control valve 52 is biased by a spring toward the throttling position (the state shown in FIG. 2) and is switched continuously from the throttling position to the open position according to the pilot pressure inputted to its pilot pressure port. As shown in FIG. 2, the open position of the flow control valve 52 is provided with not only a channel for opening the bottom line 47 but also a regeneration hydraulic line for connecting the bottom line 47 to the rod line 48. The regeneration hydraulic line has a check valve, by which the flow of the hydraulic fluid from the bottom line 47 to the rod line 48 via the regeneration hydraulic line is allowed while blocking the flow of the hydraulic fluid from the rod line 48 to the bottom line 47. The flow control valve 52 also functions as the aforementioned return fluid control valve in the sense of adjusting/controlling the flow rate of the return fluid through the bottom line 47. The bottom line 47 is also provided with a check valve 62 in parallel with the flow control valve 52. By the check valve 62, the flow of the hydraulic fluid from the control valve 42 to the boom cylinder 32 is allowed while blocking the flow of the hydraulic fluid from the boom cylinder 32 to the control valve 42 not via the flow control valve 52.

Regeneration Valve

The regeneration valve 53, as a selector valve having a throttling position and an open position, is arranged in the regeneration line 56 connecting the bottom line 47 to the regeneration motor 55. The regeneration valve 53 is biased by a spring toward the throttling position (the state shown in FIG. 2) and is switched continuously from the throttling position to the open position according to the pilot pressure inputted to its pilot pressure port. The regeneration valve 53 also functions as the aforementioned return fluid control valve in the sense of controlling the flow rate of the hydraulic fluid flowing through the regeneration line 56. A check valve 63 is arranged in the regeneration line 56 at a position between the regeneration valve 53 and the regeneration motor 55. By the check valve 63, the flow of the hydraulic fluid from the bottom line 47 to the regeneration motor 55 via the regeneration line 56 is allowed while blocking the flow of the hydraulic fluid from the regeneration motor 55 to the bottom line 47.

(6) Solenoid Valve for Return Fluid Control Valve

The solenoid valve for return fluid control valve means a solenoid valve adapted to control the pilot pressure driving a corresponding return fluid control valve. The number of the solenoid valves for return fluid control valve can vary depending on the number of the return fluid control valves. In this embodiment, a solenoid valve for bypass valve 57, a solenoid valve for flow control valve 58 and a solenoid valve for regeneration valve 59 are provided as the solenoid valves for return fluid control valve.

Solenoid Valve for Bypass Valve

The solenoid valve for bypass valve 57 is a solenoid-operated proportional pressure reducing valve adapted to control the pilot pressure driving the bypass valve 51. The solenoid valve for bypass valve 57 has a function of generating pilot secondary pressure (control pilot pressure) from the pilot primary pressure supplied from the pilot hydraulic pressure source 45 according to a control command from a controller (not shown) and supplying the pilot secondary pressure to the bypass valve 51. The solenoid valve for bypass valve 57 in this embodiment has an open position for connecting the pilot hydraulic pressure source 45 to the pilot pressure port of the bypass valve 51 and a drain position for connecting the pilot hydraulic pressure source 45 to the tank 44 and is capable of continuously changing the pilot secondary pressure according to the control command. The control command from the controller to the solenoid valve for bypass valve 57 is generated according to a program based on the current condition (e.g., the operation amount of the boom control lever 46).

Solenoid Valve for Flow Control Valve

The solenoid valve for flow control valve 58 is a solenoid-operated proportional pressure reducing valve adapted to control the pilot pressure driving the flow control valve 52. The solenoid valve for flow control valve 58 has a function of generating pilot secondary pressure (control pilot pressure) from output pilot pressure (boom lowering pilot pressure) of the boom control lever 46 according to a control command from the controller and supplying the pilot secondary pressure to the flow control valve 52. The solenoid valve for flow control valve 58 in this embodiment has an open position adapted to connect the boom control lever 46 to the pilot pressure port of the flow control valve 52 and a drain position for connecting the boom control lever 46 to the tank 44 and is capable of continuously changing the pilot secondary pressure according to the control command. The control command from the controller to the solenoid valve for flow control valve 58 is generated according to a program based on the current condition (e.g., the operation amount of the boom control lever 46).

Solenoid Valve for Regeneration Valve

The solenoid valve for regeneration valve 59 is a solenoid-operated proportional pressure reducing valve adapted to control the pilot pressure driving the regeneration valve 53. The solenoid valve for regeneration valve 59 has a function of generating pilot secondary pressure (control pilot pressure) from the pilot primary pressure supplied from the pilot hydraulic pressure source 45 according to a control command from the controller and supplying the pilot secondary pressure to the regeneration valve 53. The solenoid valve for regeneration valve 59 in this embodiment has an open position for connecting the pilot hydraulic pressure source 45 to the pilot pressure port of the regeneration valve 53 and a drain position for connecting the pilot hydraulic pressure source 45 to the tank 44 and is capable of continuously changing the pilot secondary pressure according to the control command. The control command from the controller to the solenoid valve for regeneration valve 59 is generated according to a program based on the current condition (e.g., the operation amount of the boom control lever 46).

(7) Malfunction Prevention Device

The malfunction prevention device is a device that is adapted to activate by pressure fluctuation caused by malfunction of a solenoid valve for return fluid control valve, for example, and function to interrupt the delivery of the pilot secondary pressure from the solenoid valve for return fluid control valve to the corresponding return fluid control valve. In this embodiment, a quick acceleration prevention valve 64 and a shuttle valve 65 are provided as the malfunction prevention device.

Shuttle Valve

One input port of the shuttle valve 65 is connected to a secondary pressure port of the solenoid valve for flow control valve 58 via a pilot line PL1, while the other input port of the shuttle valve 65 is connected to the quick acceleration prevention valve 64 via a pilot line PL3. The output port of the shuttle valve 65 is connected to the pilot pressure port of the flow control valve 52. With this configuration, the higher pressure is selected by the shuttle valve 65 from the pilot pressure led from the solenoid valve for flow control valve 58 (pilot line PL1) and the pilot pressure led from the quick acceleration prevention valve 64 (pilot line PL3) and the selected higher pilot pressure is led to the pilot pressure port of the flow control valve 52.

Quick Acceleration Prevention Valve

The quick acceleration prevention valve 64 is arranged in a delivery line PL2 of the pilot hydraulic pressure source 45 to form a circuit in parallel with the solenoid valve for flow control valve 58. Via the quick acceleration prevention valve 64, the pilot primary pressure of the pilot hydraulic pressure source 45 is led to the solenoid valve for bypass valve 57 and the solenoid valve for regeneration valve 59. The quick acceleration prevention valve 64 uses the pressure in the regeneration line 56 between the regeneration valve 53 and the regeneration motor 55 (i.e., between the regeneration valve 53 and the regeneration check valve 63) as its switch pressure and is switched from a switched position (the position shown in FIG. 2) to a normal position when the switch pressure reaches a preset pressure (spring force of the spring of the quick acceleration prevention valve 64). The switch pressure is led to the pilot pressure port of the quick acceleration prevention valve 64 via a pilot line PL4. The pilot line PL4 has a fixed restrictor 66. When the quick acceleration prevention valve 64 is at the normal position, primary pressure ports of the solenoid valve for bypass valve 57 and the solenoid valve for regeneration valve 59 are connected to the pilot hydraulic pressure source 45, while the pilot line PL3 is connected to the tank 44. When the quick acceleration prevention valve 64 is switched to the switched position (the position shown in FIG. 2), the primary pressure ports of the solenoid valve for bypass valve 57 and the solenoid valve for regeneration valve 59 are connected to the tank 44, while the shuttle valve 65 is connected to an output line PL5 of the boom control lever 46 via the pilot line PL3.

3. Operation

Next, the operation of the hydraulic system will be explained below in regard to a normal state and an operating state of the malfunction prevention device.

(1) Normal State

When the boom bottom pressure as the holding pressure of the boom cylinder 32 is acting on the regeneration motor 55 via the regeneration valve 53 at the throttling position and the check valve 63, the revolution speed of the regeneration motor 55 is maintained at 0 and the boom bottom pressure works on the entire region of the regeneration line 56. The boom bottom pressure in the regeneration line 56 acts on the quick acceleration prevention valve 64 via the fixed restrictor 66, by which the quick acceleration prevention valve 64 is maintained at the normal position.

When the quick acceleration prevention valve 64 is at the normal position, the pilot primary pressure of the pilot hydraulic pressure source 45 is led to the primary pressure ports of the solenoid valve for bypass valve 57 and the solenoid valve for regeneration valve 59. The solenoid valve for bypass valve 57 and the solenoid valve for regeneration valve 59 are operated by commands that are outputted from the controller (not shown) based on the current condition and generate the pilot secondary pressures (control pilot pressures) by reducing the pilot primary pressure. The pilot secondary pressures are respectively inputted to the pilot pressure ports of the bypass valve 51 and the regeneration valve 53 and control the open angles of the bypass valve 51 and the regeneration valve 53. On the other hand, the pilot line PL3 is connected to the tank 44 via the quick acceleration prevention valve 64, and thus the shuttle valve 65 constantly selects the pilot secondary pressure generated by the solenoid valve for flow control valve 58 and inputs the pilot secondary pressure to the pilot pressure port of the flow control valve 52. Therefore, the bypass valve 51, the flow control valve 52 and the regeneration valve 53 operate in cooperation with the solenoid valve for bypass valve 57, the solenoid valve for flow control valve 58 and the solenoid valve for regeneration valve 59, respectively, and are controlled in the solenoid pilot manner according to the command values outputted from the controller (not shown) based on the current condition.

(2) Operating State

When a malfunction of the flow control valve 52 fully opening in contradiction to the current condition has occurred due to abnormality in the command value to the solenoid valve for flow control valve 58, for example, the flow rate of the return fluid from the boom cylinder 32 flowing into the tank 44 via the flow control valve 52 increases more than needed. As a result, the pressure in the regeneration line 56 drops excessively, the switch pressure led to the quick acceleration prevention valve 64 via the pilot line PL4 and the fixed restrictor 66 falls below the preset value, and the quick acceleration prevention valve 64 is switched to the switched position.

By the switching of the quick acceleration prevention valve 64 to the switched position, the primary pressure ports of the solenoid valve for bypass valve 57 and the solenoid valve for regeneration valve 59 are connected to the tank 44. Accordingly, the bypass valve 51 and the regeneration valve 53 stop receiving the pilot secondary pressures of the solenoid valve for bypass valve 57 and the solenoid valve for regeneration valve 59 and are fixed at the closed position and the throttling position, respectively. Further, since the pilot line PL3 is connected to the output line PL5 of the boom control lever 46, the shuttle valve 65 is supplied with the output pilot pressure of the boom control lever 46 via the pilot lines PL1 and PL3. In this case, the pilot pressure supplied via the pilot line PL1 has been reduced by the solenoid valve for flow control valve 58 whereas the pilot pressure supplied via the pilot line PL3 has not been reduced, and thus the output pilot pressure of the boom control lever 46 supplied via the pilot line PL3 is constantly selected by the shuttle valve 65 and inputted to the pilot pressure port of the flow control valve 52. In other words, the output pilot pressure of the boom control lever 46 is inputted to the pilot pressure port of the flow control valve 52 by bypassing the solenoid valve for flow control valve 58.

4. Effects

When a malfunction of the flow control valve 52 fully opening in contradiction to the control logic has occurred due to abnormality in the command value to the solenoid valve for flow control valve 58 or the like, the return fluid from the boom cylinder 32 flows into the tank 44 more than needed and irregular operation of the boom 31 suddenly dropping in contradiction to the operator's intension can possibly occur during the boom lowering operation.

In this embodiment, the quick acceleration prevention valve 64 is activated in such cases due to the drop in the pressure in the regeneration line 56 as explained above, by which the primary pressure ports of the solenoid valve for bypass valve 57 and the solenoid valve for regeneration valve 59 are connected to the tank 44 and the output line PL5 of the boom control lever 46 is connected to the pilot pressure port of the flow control valve 52 by bypassing the solenoid valve for flow control valve 58. Accordingly, the delivery of the pilot pressure from the solenoid valve for flow control valve 58 to the flow control valve 52 is interrupted and the regeneration valve unit 72 is disconnected from the electric system. Consequently, the regeneration valve unit 72 is operated purely hydraulically by the output pilot pressure of the boom control lever 46. Therefore, the irregularity in the operation of the front structure can be suppressed without being affected by the failure in the electric system. Further, safety can also be improved since the circuit is made up exclusively of hydraulic devices having few failure factors at the time of the abnormal operation of a return fluid control valve.

Furthermore, since the delivery of the switch pressure to the quick acceleration prevention valve 64 is delayed by providing the pilot line PL4 with the fixed restrictor 66, too sensitive operation of the quick acceleration prevention valve 64 due to transient pressure fluctuation in the regeneration line 56 can be prevented and stable operation of the hydraulic system can be provided.

5. Others

While a configuration including the bypass line 49, the bypass valve 51 and the solenoid valve for bypass valve 57 for improving the energy recovery efficiency has been described as an example in the above explanation of this embodiment, the bypass line 49, the bypass valve 51 and the solenoid valve for bypass valve 57 can be left out since they are not essential for achieving the aforementioned effects. Further, the fixed restrictor 66 can also be left out in cases where stable operation of the quick acceleration prevention valve 64 can be expected by properly setting the switch pressure at which the quick acceleration prevention valve 64 is switched (spring force of the spring), for example. It is also possible to form the flow control valve 52 to have a closed position instead of the throttling position or to leave out the regeneration hydraulic line for the open position.

Second Embodiment

1. Configuration

Figure 3:
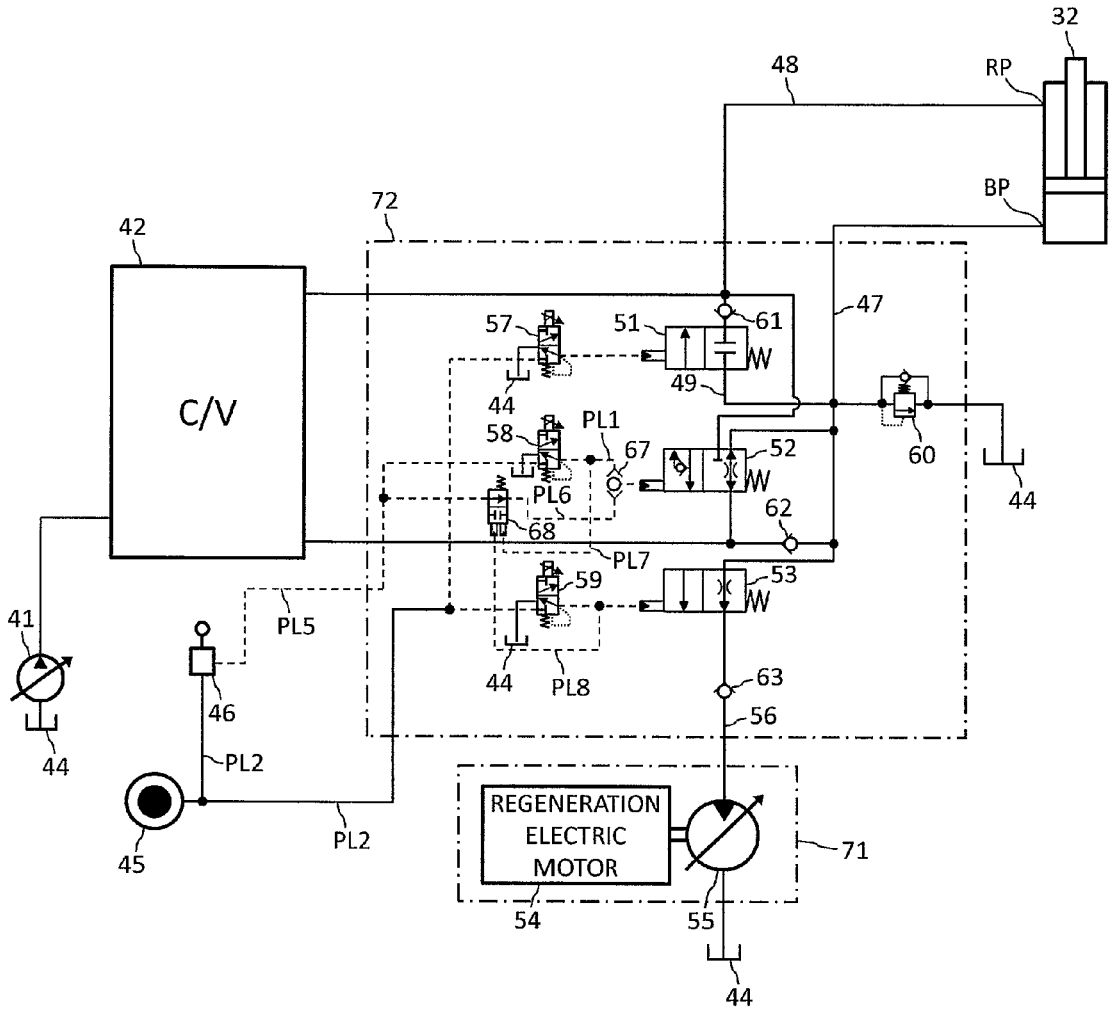
FIG. 3 is a hydraulic circuit diagram of a hydraulic system in accordance with a second embodiment of the present invention including an energy regeneration circuit.

FIG. 3 is a hydraulic circuit diagram of a hydraulic system in accordance with a second embodiment of the present invention including an energy regeneration circuit. Elements in FIG. 3 equivalent to those in FIG. 2 (first embodiment) are assigned the same reference characters as in FIG. 2 and repeated explanation thereof is omitted for brevity.

This embodiment differs from the first embodiment only in the configuration of the malfunction prevention device. In this embodiment, a rapid deceleration prevention valve 68 and a shuttle valve 67 are provided as the malfunction prevention device as shown in FIG. 3. The quick acceleration prevention valve 64, the fixed restrictor 66, the shuttle valve 65 and the pilot line PL4 which have been explained referring to FIG. 2 are left out.

Shuttle Valve

One input port of the shuttle valve 67 is connected to the secondary pressure port of the solenoid valve for flow control valve 58 via the pilot line PL1, while the other input port of the shuttle valve 67 is connected to the rapid deceleration prevention valve 68 via a pilot line PL6. The output port of the shuttle valve 67 is connected to the pilot pressure port of the flow control valve 52. With this configuration, the higher pressure is selected by the shuttle valve 67 from the pilot pressure led from the solenoid valve for flow control valve 58 (pilot line PL1) and the pilot pressure led from the rapid deceleration prevention valve 68 (pilot line PL6) and the selected higher pilot pressure is led to the pilot pressure port of the flow control valve 52.

Rapid Deceleration Prevention Valve

The rapid deceleration prevention valve 68, as a selector valve having a closed position and an open position, is arranged in the output line PL5 of the boom control lever 46 to form a circuit in parallel with the solenoid valve for flow control valve 58. The output pilot pressure of the boom control lever 46 is led to the shuttle valve 67 via the solenoid valve for flow control valve 58 and the pilot line PL1 and also via the rapid deceleration prevention valve 68 and the pilot line PL6. The rapid deceleration prevention valve 68 uses the sum total of the pilot secondary pressure from the solenoid valve for flow control valve 58 (pressure downstream of the valve 58) and the pilot secondary pressure from the solenoid valve for regeneration valve 59 (pressure downstream of the valve 59) as its switch pressure and is switched from the closed position to the open position (the position shown in FIG. 3) when the switch pressure falls below a preset pressure (spring force of the spring of the rapid deceleration prevention valve 68). The switch pressure is led to the pilot pressure port of the rapid deceleration prevention valve 68 via pilot lines PL7 and PL8. When the rapid deceleration prevention valve 68 is at the closed position, the pilot line PL6 is disconnected from the output line PL5 of the boom control lever 46 and the delivery of the output pilot pressure from the boom control lever 46 to the shuttle valve 67 via the rapid deceleration prevention valve 68 is interrupted. When the rapid deceleration prevention valve 68 is switched to the open position, the pilot line PL6 is connected to the output line PL5 and the output pilot pressure of the boom control lever 46 is led to the primary pressure port of the shuttle valve 67 via the rapid deceleration prevention valve 68.

The rest of the configuration is equivalent to that in the first embodiment.

2. Operation (1) Normal State

In the normal state, switch pressure not less than the preset pressure is inputted to the rapid deceleration prevention valve 68 since the solenoid valve for flow control valve 58 or the solenoid valve for regeneration valve 59 is outputting pilot secondary pressure according to the command from the controller (not shown). Thus, the rapid deceleration prevention valve 68 remains at the closed position and each of the bypass valve 51, the flow control valve 52 and the regeneration valve 53 receives the pilot secondary pressure from the corresponding solenoid valve (solenoid valve for bypass valve 57, solenoid valve for flow control valve 58, solenoid valve for regeneration valve 59) at its pilot pressure port and changes its opening area according to the pilot secondary pressure. Thus, the bypass valve 51, the flow control valve 52 and the regeneration valve 53 are controlled in the solenoid pilot manner.

(2) Operating State

When an abnormality like a rapid decrease in the pilot secondary pressures of the solenoid valve for flow control valve 58 and the solenoid valve for regeneration valve 59 has occurred due to an electrical failure such as a power supply failure of the solenoid valve drivers, the switch pressure inputted to the rapid deceleration prevention valve 68 (i.e., the sum total of the pilot secondary pressures of the solenoid valves 58 and 59) falls below the preset pressure and the rapid deceleration prevention valve 68 is switched to the open position (the position shown in FIG. 3). Accordingly, the output line PL5 of the boom control lever 46 is connected to the pilot line PL6 and the output pilot pressure of the boom control lever 46 is supplied to an input port of the shuttle valve 67 via the rapid deceleration prevention valve 68. The pilot pressure supplied to the shuttle valve 67 via the pilot line PL1 has been reduced by the solenoid valve for flow control valve 58 whereas the pilot pressure supplied to the shuttle valve 67 via the pilot line PL6 has not been reduced, and thus the output pilot pressure of the boom control lever 46 supplied via the pilot line PL6 is constantly selected by the shuttle valve 67 and inputted to the pilot pressure port of the flow control valve 52. In other words, the output pilot pressure of the boom control lever 46 is inputted to the pilot pressure port of the flow control valve 52 by bypassing the solenoid valve for flow control valve 58.

3. Effects

When the flow control valve 52 and the regeneration valve 53 close rapidly during the boom lowering operation in contradiction to the control logic due to a factor like an abnormality in the command values to the solenoid valve for flow control valve 58 and the solenoid valve for regeneration valve 59 (caused by trouble in the electric system or a runaway of the controller, for example), the descending speed of the boom 31 decreases suddenly. In this embodiment, however, when the sum total of the pilot secondary pressures of the solenoid valve for flow control valve 58 and the solenoid valve for regeneration valve 59 falls below the preset pressure, the rapid deceleration prevention valve 68 opens and the output pilot pressure of the boom control lever 46 is led to the pilot pressure port of the flow control valve 52 by bypassing the solenoid valve for flow control valve 58. Accordingly, the delivery of the pilot secondary pressure from the solenoid valve for flow control valve 58 to the flow control valve 52 is interrupted and the flow control valve 52 is operated purely hydraulically by the output pilot pressure of the boom control lever 46. Consequently, the irregularity in the operation of the front structure (in this embodiment, unintended rapid deceleration of the descending speed of the boom 31) can be suppressed while avoiding the influence of the failure in the electric system.

Third Embodiment

Figure 4:
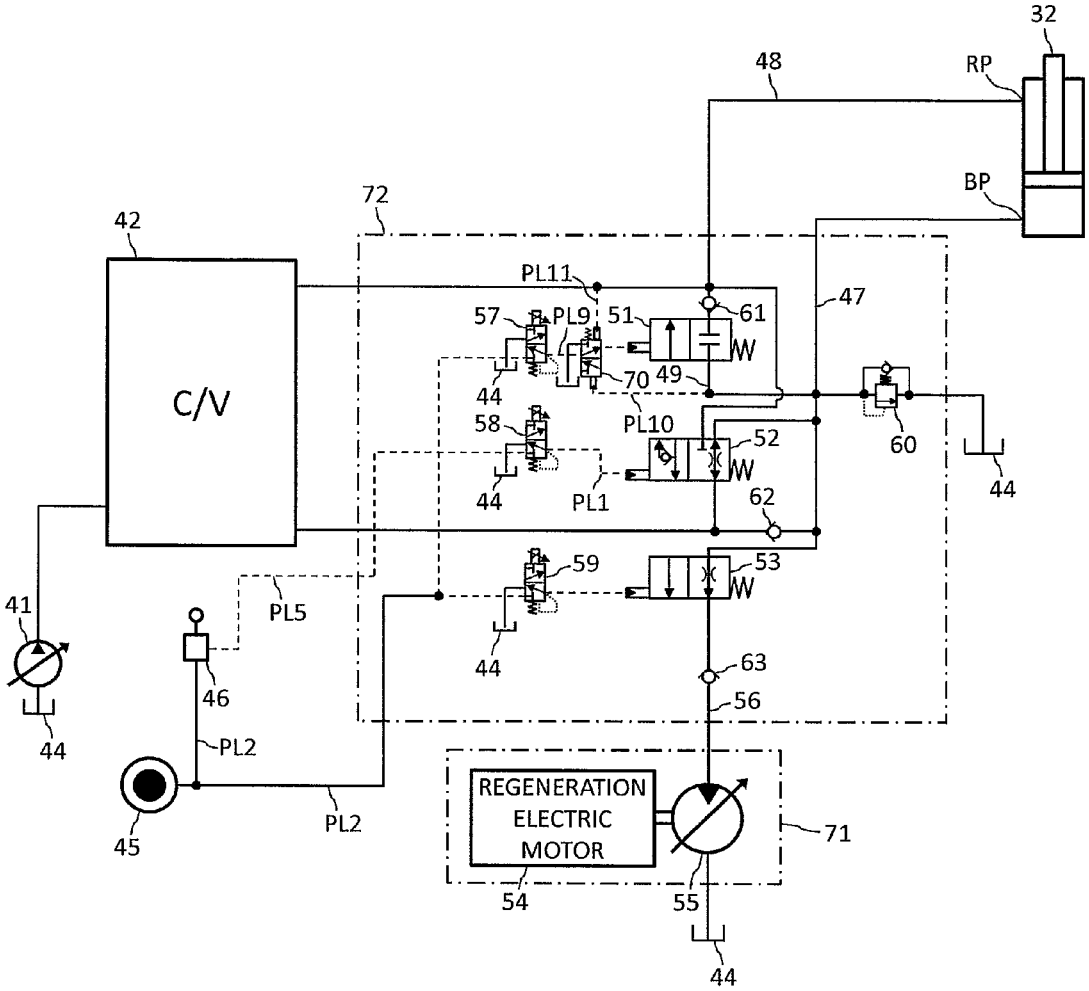
FIG. 4 is a hydraulic circuit diagram of a hydraulic system in accordance with a third embodiment of the present invention including an energy regeneration circuit.

FIG. 4 is a hydraulic circuit diagram of a hydraulic system in accordance with a third embodiment of the present invention including an energy regeneration circuit. Elements in FIG. 4 equivalent to those in FIG. 2 (first embodiment) are assigned the same reference characters as in FIG. 2 and repeated explanation thereof is omitted for brevity.

1. Configuration

This embodiment differs from the first embodiment in the configuration of the malfunction prevention device. As shown in FIG. 4, a bypass shut-off valve 70 is employed in this embodiment as a valve serving also as the malfunction prevention device. The quick acceleration prevention valve 64, the fixed restrictor 66, the shuttle valve 65 and the pilot line PL4 which have been explained referring to FIG. 2 are left out.

The bypass shut-off valve 70, as a selector valve having an open position and a drain position, is arranged in a pilot line PL9 connecting the solenoid valve for bypass valve 57 to the bypass valve 51. The pressure in the bottom line 47 and the pressure in the rod line 48 are led to pilot pressure ports on both sides of the bypass shut-off valve 70 via pilot lines PL10 and PL11, respectively. The bypass shut-off valve 70 is switched according to the pressure ratio between the bottom line 47 and the rod line 48 (thrust of the boom cylinder 32). The principle of the operation of the bypass shut-off valve 70 will be explained below.

The thrust (load) of the boom cylinder 32 can be described as:

$$F=Ab\cdot Pb-Ar\cdot Pr$$

where "Ab" represents the pressure receiving area on the bottom side of the boom cylinder 32, "Ar" represents the pressure receiving area on the rod side of the boom cylinder 32, "Pb" represents the boom bottom pressure, and "Pr" represents the boom rod pressure. If the bypass shut-off valve 70 is designed so that its pressure receiving area Asb on the bottom line 47's side and its pressure receiving area Asr on the rod line 48's side satisfy Asb:Asr=Ab:Ar, the bypass shut-off valve 70 is switched according to the thrust of the boom cylinder 32. Specifically, since the bypass shut-off valve 70 is biased by a spring toward the open position, when the thrust of the boom cylinder 32 exceeds a preset value that is set by the spring, the bypass shut-off valve 70 is switched from the open position to the drain position and adapted to connect the pilot pressure port of the bypass valve 51 to the tank 44.

The rest of the configuration is equivalent to that in the first embodiment.

2. Operation (1) Normal State

In the normal state, the bypass valve 51 is controlled by the controller (not shown) via the solenoid valve for bypass valve 57 within a range in which the boom bottom pressure does not exceed the preset relief pressure of the relief valve 60, by which the bypass line 49 is connected and interrupted.

(2) Operating State

In cases where the solenoid valve for bypass valve 57 is fixed at the open position and a command for opening the bypass valve 51 is outputted continuously due to an electrical failure such as a power supply failure of the solenoid valve driver (not shown) or an abnormality in the command value to the solenoid valve for bypass valve 57, when the boom bottom pressure rises to the vicinity of the preset relief pressure of the relief valve 60 (i.e., when the thrust F exceeds the preset value) due to the opened bypass valve 51, the bypass shut-off valve 70 is switched to the drain position and the bypass valve 51 is switched to the closed position. Thereafter, when the boom bottom pressure Pb drops to a level at which the boom bottom pressure does not exceed the preset relief pressure of the relief valve 60 even if the bypass valve 51 opens (i.e., when the thrust F falls below the preset value), the bypass shut-off valve 70 is switched to the open position and then the bypass valve 51 is switched to the open position.

3. Effects

Even though the regeneration device 71 is capable of recovering the hydraulic energy as electric energy, a surplus hydraulic fluid flow beyond the capacity of the regeneration device 71 has to be dumped by opening the flow control valve 52. However, the energy recovery efficiency can be increased by opening the bypass valve 51 and returning part of the return fluid to the rod line 48. For example, when an operation for lowering the boom 31 at a relatively high speed is performed, the flow control valve 52 is controlled by the controller (not shown) so that no hydraulic fluid flow beyond the capacity of the regeneration device 71 flows into the regeneration line 56. In this case, the bypass valve 51 is properly opened by the controller and the hydraulic fluid is returned from the bottom line 47 to the rod line 48 within an extent in which the relief valve 60 is not opened, by which the energy efficiency is increased.

However, when the solenoid valve for bypass valve 57 is opened in contradiction to the original control logic due to a failure in the electric system, the bottom line 47 is connected to the rod line 48 and the pressure difference between the bottom line 47 and the rod line 48 decreases, and consequently, the pressure in the bottom line 47 rises. If the relief valve 60 is activated by the high pressure in the bottom line 47, the boom 31 drops irrespective of the operation by the operator.

In contrast, in this embodiment employing the bypass shut-off valve 70, the bypass shut-off valve 70 is closed in response to the rise in the boom bottom pressure and the delivery of the pilot secondary pressure from the solenoid valve for bypass valve 57 to the bypass valve 51 is interrupted depending on the current condition. Accordingly, even when the operation of the solenoid valve for bypass valve 57 deviates from the control logic, the bypass valve 51 is blocked in a situation in which the boom bottom pressure can exceed the relief pressure. Consequently, the irregularity in the operation of the front structure, for example, the dropping of the boom 31 not intended by the operator in this embodiment, can be prevented.

Fourth Embodiment

The first through third embodiments which have been described above can be combined in any way. For example, it is possible to combine two arbitrarily selected embodiments or all the three embodiments. In this fourth embodiment, an example combining all the three embodiments will be described.

Figure 5:
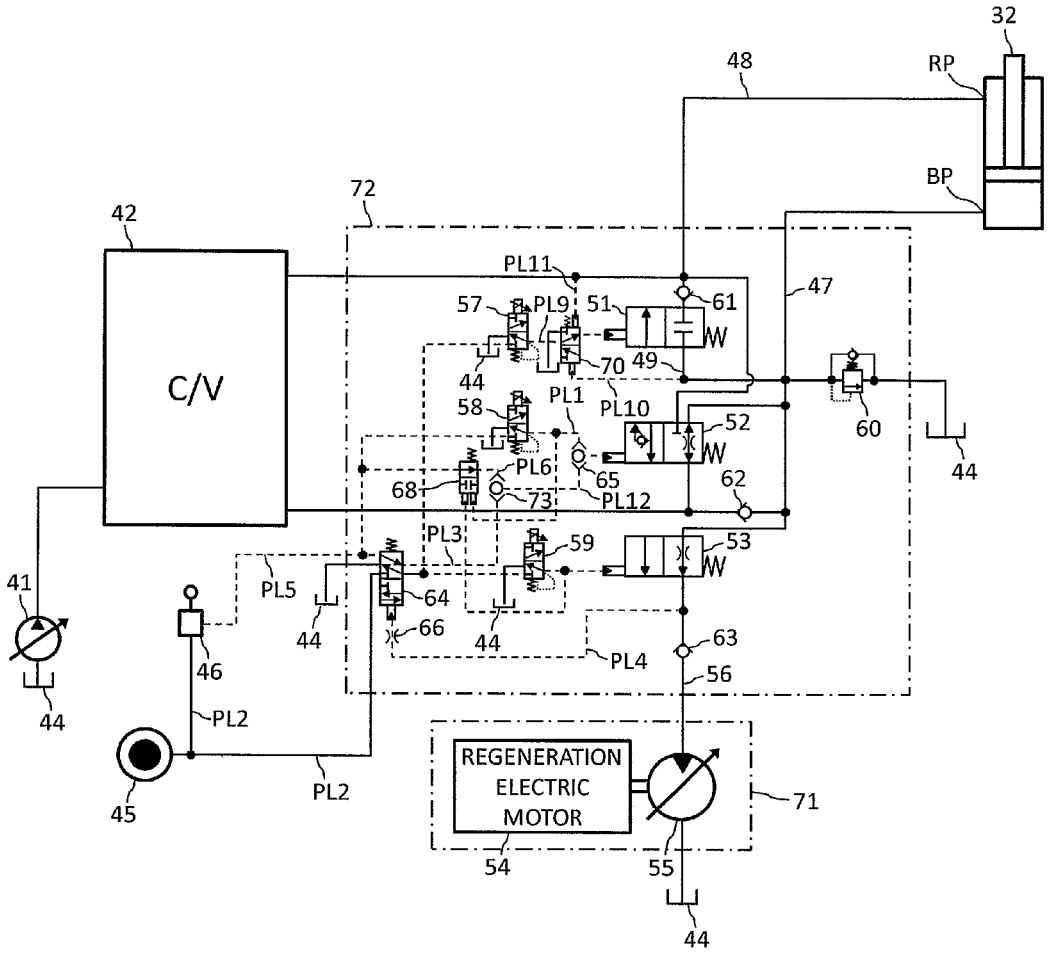
FIG. 5 is a hydraulic circuit diagram of a hydraulic system in accordance with a fourth embodiment of the present invention including an energy regeneration circuit.

FIG. 5 is a hydraulic circuit diagram of a hydraulic system in accordance with the fourth embodiment of the present invention including an energy regeneration circuit. Elements in FIG. 5 equivalent to those in the aforementioned figures (above embodiments) are assigned the already used reference characters and repeated explanation thereof is omitted for brevity.

In this embodiment, the quick acceleration prevention valve 64, the rapid deceleration prevention valve 68, the bypass shut-off valve 70, etc. are provided as the malfunction prevention device. The output ports of the quick acceleration prevention valve 64 and the rapid deceleration prevention valve 68 are connected to input ports of a shuttle valve 73 via the pilot lines PL3 and PL6, respectively. The secondary pressure port of the solenoid valve for flow control valve 58 is connected to one input port of the shuttle valve 65 via the pilot line PL1, while the output port of the shuttle valve 73 is connected to the other input port of the shuttle valve 65 via the pilot line PL12. The output port of the shuttle valve 65 is connected to the pilot pressure port of the flow control valve 52. The connective relationship, etc. of the bypass shut-off valve 70 are equivalent to those in the third embodiment. The rest of the configuration is equivalent to that in the first through third embodiments. The first through third embodiments can be easily combined together as above and the effects of these embodiments can be properly achieved by the combination.

Others

While the engine 22 is used in the above embodiments as an example of the prime mover for the hydraulic pump 41 and so forth, there are also cases where an electric motor is used as the prime mover. Further, while the above explanation has been given by taking a hydraulic excavator as an example of the construction machinery to which the hydraulic system according to the present invention is applied, the present invention is applicable also to other types of construction machineries such as wheel loaders. While the present invention is applied to a construction machinery of the so-called crawler type in the above explanation, the present invention is applicable also to construction machineries of the so-called wheel type. Furthermore, while the irregularity in the operation of the boom 31 is suppressed in the above explanation, the present invention can be employed also for suppressing irregularity in the operation of the arm 33 or the bucket 35 as needed.

What is claimed is:

1. A hydraulic system for construction machinery, comprising:

a hydraulic pump;

a cylinder control valve adapted to control the flow of hydraulic fluid from the hydraulic pump to the hydraulic cylinder;

an operating device adapted to operate the cylinder control valve;

a regeneration motor adapted to be driven by return fluid from one hydraulic fluid port of the hydraulic cylinder;

a regeneration electric motor adapted to convert rotary power of the regeneration motor into electric energy;

a pilot hydraulic pressure source;

at least one return fluid control valve adapted to control the flow of the return fluid according to pilot pressure that is led from the pilot hydraulic pressure source in conjunction with an operation on the operating device;

at least one solenoid valve for return fluid control valve adapted to control the pilot pressure for driving the return fluid control valve;

a malfunction prevention device adapted to be capable of interrupting the delivery of the pilot pressure from the solenoid valve for return fluid control valve to the return fluid control valve;

a flow control valve which is arranged in a line connecting the one hydraulic fluid port to the cylinder control valve and a regeneration valve which is arranged in a regeneration line connecting the line and the regeneration motor are provided as the return fluid control valves;

a solenoid valve for flow control valve adapted to control pilot pressure for driving the flow control valve and a solenoid valve for regeneration valve adapted to control pilot pressure for driving the regeneration valve are provided as the solenoid valves for return fluid control valve; and a quick acceleration prevention valve which is arranged in parallel with the solenoid valve for flow control valve, and a shuttle valve adapted to select higher pressure from pilot pressures led from the solenoid valve for flow control valve and the quick acceleration prevention valve, the shuttle valve adapted to lead the selected higher pressure to a pilot pressure port of the flow control valve are provided as the malfunction prevention device;

wherein when the pressure in the regeneration line between the regeneration valve and the regeneration motor falls below a preset value, the quick acceleration prevention valve is configured to connect the solenoid valve for regeneration valve to a tank, connect an output line of the operating device to the shuttle valve, and lead output pilot pressure of the operating device to the pilot pressure port of the flow control valve by bypassing the solenoid valve for flow control valve.

2. The hydraulic system for a-construction machinery according to claim 1, further including:

a bypass valve which is arranged in a bypass line connecting together two lines connecting two hydraulic fluid ports of the hydraulic cylinder to the cylinder control valve is provided as the return fluid control valve; and a solenoid valve for bypass valve adapted to control pilot pressure for driving the bypass valve is provided as the solenoid valve for return fluid control valve, wherein:

the malfunction prevention device includes a bypass shut-off valve which is arranged in a pilot line connecting the solenoid valve for bypass valve to a pilot pressure port of the bypass valve; and when a pressure ratio between the pressure in a bottom line connected to a bottom port of the hydraulic cylinder and the pressure in a rod line connected to a rod port of the hydraulic cylinder increases above a preset value, the bypass shut-off valve is adapted to connect the pilot pressure port of the bypass valve to a tank.

3. A hydraulic system for construction machinery comprising:

a hydraulic pump;

a cylinder control valve adapted to control the flow of hydraulic fluid from the hydraulic pump to a hydraulic cylinder;

an operating device adapted to operate the cylinder control valve;

a regeneration motor adapted to be driven by return fluid from one hydraulic fluid port of the hydraulic cylinder;

a regeneration electric motor adapted to convert rotary power of the regeneration motor into electric energy;

a pilot hydraulic pressure source;

at least one return fluid control valve adapted to control the flow of the return fluid according to pilot pressure that is led from the pilot hydraulic pressure source in conjunction with an operation on the operating device;

at least one solenoid valve for return fluid control valve adapted to control the pilot pressure for driving the return fluid control valve;

a malfunction prevention device adapted to be capable of interrupting the delivery of the pilot pressure from the solenoid valve for return fluid control valve to the return fluid control valve;

a flow control valve which is arranged in a line connecting the one hydraulic fluid port to the cylinder control valve and a regeneration valve which is arranged in a regeneration line connecting the line and the regeneration motor are provided as the return fluid control valves; and a solenoid valve for flow control valve adapted to control pilot pressure for driving the flow control valve and a solenoid valve for regeneration valve adapted to control pilot pressure for driving the regeneration valve are provided as the solenoid valves for return fluid control valve, wherein the malfunction prevention device includes a rapid deceleration prevention valve which is arranged in parallel with the solenoid valve for flow control valve, and a shuttle valve adapted to select higher pressure from pilot pressures led from the solenoid valve for flow control valve and the rapid deceleration prevention valve, the shuttle valve adapted to lead the selected higher pressure to a pilot pressure port of the flow control valve; and wherein when the sum total of pilot secondary pressures of the solenoid valve for flow control valve and the solenoid valve for regeneration valve falls below a preset pressure, the rapid deceleration prevention valve is configured to connect an output line of the operating device to the shuttle valve, and lead output pilot pressure of the operating device to the pilot pressure port of the flow control valve by bypassing the solenoid valve for flow control valve.

4. The hydraulic system for construction machinery according to claim 3, further including:

a bypass valve which is arranged in a bypass line connecting together two lines connecting two hydraulic fluid ports of the hydraulic cylinder to the cylinder control valve is provided as the return fluid control valve; and a solenoid valve for bypass valve adapted to control pilot pressure for driving the bypass valve is provided as the solenoid valve for return fluid control valve, wherein:

the malfunction prevention device includes a bypass shut-off valve which is arranged in a pilot line connecting the solenoid valve for bypass valve to a pilot pressure port of the bypass valve; and when a pressure ratio between the pressure in a bottom line connected to a bottom port of the hydraulic cylinder and the pressure in a rod line connected to a rod port of the hydraulic cylinder increases above a preset value, the bypass shut-off valve is adapted to connect the pilot pressure port of the bypass valve to a tank.

* * * * *